US007263481B2

(12) United States Patent
Jabri et al.

(10) Patent No.: US 7,263,481 B2
(45) Date of Patent: Aug. 28, 2007

(54) METHOD AND APPARATUS FOR IMPROVED QUALITY VOICE TRANSCODING

(75) Inventors: Marwan A. Jabri, Broadway (AU); Jianwei Wang, Killarney Heights (AU); Nicola Chong-White, Chatswood (AU); Michael Ibrahim, Ryde (AU)

(73) Assignee: Dilithium Networks Pty Limited (AU)

( * ) Notice: Subject to any disclaimer, the term of this patent is extended or adjusted under 35 U.S.C. 154(b) by 710 days.

(21) Appl. No.: 10/754,468

(22) Filed: Jan. 9, 2004

(65) Prior Publication Data

US 2004/0158463 A1 Aug. 12, 2004

Related U.S. Application Data

(60) Provisional application No. 60/439,420, filed on Jan. 9, 2003.

(51) Int. Cl.
*G10L 19/04* (2006.01)

(52) U.S. Cl. ..... 704/219; 704/220; 704/200.1; 704/222; 704/223; 704/229

(58) Field of Classification Search ..... 704/219, 704/200.1, 220, 222, 223, 229
See application file for complete search history.

(56) References Cited

U.S. PATENT DOCUMENTS 5,491,771 A * 2/1996 Gupta et al. ..... 704/223
5,495,555 A * 2/1996 Swaminathan ..... 704/207
5,845,244 A * 12/1998 Proust ..... 704/200.1
6,012,024 A * 1/2000 Hofmann ..... 704/219
6,026,356 A * 2/2000 Yue et al. ..... 704/201
6,188,980 B1 * 2/2001 Thyssen ..... 704/230
6,249,758 B1 * 6/2001 Mermelstein ..... 704/220
6,757,649 B1 * 6/2004 Gao et al. ..... 704/222
6,829,579 B2 * 12/2004 Jabri et al. ..... 704/221

(Continued)

FOREIGN PATENT DOCUMENTS

WO 00/48170 8/2000

(Continued)

OTHER PUBLICATIONS

Chen et al., "Improving the Performance of the 16kb/s LD-CELP Speech Coder," *IEEE*, Mar. 23, 1992, pp. 69-72.

(Continued)

*Primary Examiner*—Vijay Chawan
(74) *Attorney, Agent, or Firm*—Townsend and Townsend and Crew LLP

(57) ABSTRACT

A method and apparatus for a voice transcoder that converts a bitstream representing frames of data encoded according to a first voice compression standard to a bitstream representing frames of data according to a second voice compression standard using perceptual weighting that uses tuned weighting factors, such that the bitstream of a second voice compression standard to produce a higher quality decoded voice signal than a comparable tandem transcoding solution. The method includes pre-computing weighting factors for a perceptual weighting filter optimized to a specific source and destination codec pair, pre-configuring the transcoding strategies, mapping CELP parameters in the CELP parameter space according to the selected coding strategy, performing Linear Prediction analysis if specified by the transcoding strategy, perceptually weighting the speech using with tuned weighting factors, and searching for adaptive codebook and fixed-codebook parameters to obtain a quantized set of destination codec parameters.

25 Claims, 11 Drawing Sheets

U.S. PATENT DOCUMENTS

| | | | | |
|---|---|---|---|---|
| 6,961,698 | B1 * | 11/2005 | Gao et al. | 704/229 |
| 7,184,953 | B2 * | 2/2007 | Jabri et al. | 704/221 |
| 2002/0077812 | A1 | 6/2002 | Masano et al. | |
| 2004/0158647 | A1 | 8/2004 | Omura | |

FOREIGN PATENT DOCUMENTS

| | | | |
|---|---|---|---|
| WO | 01/69936 | A2 | 9/2001 |
| WO | 02/080417 | | 10/2002 |
| WO | 03/058407 | A2 | 7/2003 |

OTHER PUBLICATIONS

Kim et al., "An Efficient Transcoding Algorithm for G.723.1 and EVRC Speech Coders". Vehicular Technology Conference, 2001. VTC 2001 Fall. *IEEE*, VTS 54th, vol. 3, Oct. 7, 2001, pp. 1561-1564.

* cited by examiner

METHOD AND APPARATUS FOR IMPROVED QUALITY VOICE TRANSCODING

CROSS-REFERENCES TO RELATED APPLICATIONS

This application claims priority to U.S. Provisional Patent Application Ser. No. 60/439,420 titled "High Quality Audio Transcoding" filed Jan. 9, 2003, which is incorporated by reference herein for all purposes.

BACKGROUND OF THE INVENTION

The present invention relates generally to processing telecommunication signals. More particularly, the invention relates to a method and apparatus for improving the output signal quality of a transcoder that translates digital packets from one compression format to another compression format. Merely by way of example, the invention has been applied to voice transcoding between Code-Excited Linear Prediction (CELP) codecs, but it would be recognized that the invention has a much broader range of applicability. To this end, the class of applicable codecs is designated as being "common" codecs.

The process of converting from one voice compression format to another voice compression format can be performed using various techniques. The tandem coding approach is to fully decode the compressed signal back to a Pulse-Code Modulation (PCM) representation and then re-encode the signal. This requires a large amount of processing and incurs increased delays. More efficient approaches include transcoding methods where the compressed parameters are converted from one compression format to the other while remaining in the parameter space.

Many of the current standardized low bit rate speech coders are based on the Code-Excited Linear Prediction (CELP) model. Common parameters of a CELP coder are the linear prediction parameters, adaptive codebook lag and gain parameters, and fixed codebook index and gain parameters.

The similarities between CELP-based codecs allow one to take advantage of the processing redundancies inherent in them. FIG. 1 shows a block diagram for a typical prior art CELP decoder. The decoder receives as input a bitstream consisting of several parameters, commonly representing the fixed codebook index, fixed codebook gain, adaptive codebook gain, adaptive codebook (pitch) lag and the linear prediction (LP) parameters. The decoder constructs the fixed codeword, which is then scaled by the codebook gain. The adaptive codeword, which is a previous excitation segment that has been delayed by the pitch lag and scaled by the adaptive gain, is added to the fixed codebook contribution. The resulting excitation signal is then filtered by a short term predictor producing synthesized speech. This speech is then post-filtered in order to reduce the perceptual significance of any synthesis artifacts and improve speech quality.

FIG. 2 shows a block diagram for a typical prior art CELP encoder. The incoming speech signal is first pre-processed, for example, high-pass filtered to get rid of any superfluous information such as very low frequency information. Next, the spectral shape information is extracted by linear prediction (LP) analysis. The LP parameters are often represented as Line Spectral Pairs (LSPs) and quantized. The speech signal is then filtered using the inverse LP synthesis filter to remove the spectral envelope contribution and produce the excitation signal. Both the pre-processed speech and excitation are filtered with a perceptual weighting filter. The perceptually weighted speech is analyzed for periodicity, often using both a open loop pitch lag search and a closed loop (analysis-by-synthesis) pitch lag and pitch gain search. The pitch contribution is subtracted from the perceptually weighted speech to create a target signal for the fixed codebook search. The fixed codebook search consists of an analysis-by-synthesis algorithm, in which various code words are evaluated to minimize the error between the synthesized codeword and target signal.

Transcoding addresses the problem that occurs when two incompatible standard coders need to interoperate. The conventional prior art tandem coding solution, illustrated in FIG. 3, is to fully decode the signal from one compression format to PCM, and then to re-encode the PCM signal using the other compression format. This solution has the disadvantages of being computationally complex, it and introduces quality degradations due to the full decode and full encode. Alternatively a prior art transcoder, as shown in FIG. 4, may be used which converts the bitstream from one compression format to a different compression format without fully decoding to PCM and then re-encoding the signal.

Some transcoding approaches involve converting parameters solely in the CELP domain. These methods have the advantage of reducing computational complexity. FIG. 5 shows an example of one prior art transcoding approach in which the source codec LSPs are directly translated and quantized to the destination codec format. The speech is then synthesized using the destination codec LSPs and the remaining CELP parameters are found using a searching algorithm. This technique does not improve the quality of the transcoded signal to the fullest extent and is not necessarily the best solution in some situations.

While smart transcoding techniques that map parameters from one CELP format to another in a fast manner have been developed, a transcoding solution that provides transcoded speech of a higher quality than the conventional tandem coding solution and that may be configured and tuned for specific source and destination codec pairs is highly desirable.

SUMMARY OF THE INVENTION

According to the invention, a method and apparatus are provided for improving the output signal quality of a transcoder that translates digital packets from one compression format to another compression format by including perceptually weighting of the speech using a weighting filter with tuned weighting factors. Merely by way of example, the invention has been applied to voice transcoding between Code-Excited Linear Prediction (CELP) codecs, but it would be recognized that the invention has a much broader range of applicability, as explained herein and hereinafter referred to as common codecs.

In a specific embodiment, the present invention provides a method and apparatus for high quality voice transcoding between CELP-based voice codecs. The apparatus includes an input CELP parameters unpacking module that converts input bitstream packets to an input set of CELP parameters; a linear prediction parameters generation module for determining the destination codec Linear Prediction (LP) parameters, a perceptual weighting filter module that uses tuned weighting factors, an excitation parameter generation module for determining the excitation parameters for the destination codec, a packing module to pack the destination codec bitstream, and a control module that configures the transcoding strategies and controls the transcoding process.

The linear prediction parameters generation module includes an LP analysis module and an LP parameter interpolation and mapping module. The excitation parameter generation module includes adaptive and fixed codebook parameter searching modules and adaptive and fixed codebook parameter interpolation and mapping modules.

The method includes pre-computing weighting factors for a perceptual weighting filter that are optimized to a specific source and destination codec pair and storing them to the systems, pre-configuring the transcoding strategies, unpacking the source codec bitstream, reconstructing speech, mapping at least one but typically more than one CELP parameter in the CELP parameter space according to the selected coding strategy, performing LP analysis if specified by the transcoding strategy, perceptually weighting the speech using a weighting filter with tuned weighting factors, and searching for one or more of the adaptive codebook and fixed-codebook parameters to obtain the quantized set of destination codec parameters. Reconstructing speech does not involve any post-filtering processing. In addition, the reconstructed speech passed as input to the LP analysis and speech perceptual weighting does not undergo any pre-processing filtering or noise suppression. Mapping one or more CELP parameters includes interpolating parameters if there is a difference in frame size or subframe size between the source and destination codecs. The CELP parameters may include LP coefficients, adaptive codebook pitch lag, adaptive codebook gain, fixed codebook index, fixed codebook gain, excitation signals, and other parameters related to the source and destination codecs. Searching for adaptive codebook and fixed codebook parameters may be combined with mapping and conversion of CELP parameters to achieve high voice quality. This is controlled by the transcoding strategy. The algorithms within the searching module can be different to the algorithms used in the standard destination codec itself.

An advantage of the present invention is that it provides a transcoded voice signal with higher voice quality and lower complexity than that provided by a tandem coding solution. The processing strategy that combines both mapping and searching processes for determining parameter values can be adapted to suit different source and destination codec pairs.

The objects, features, and advantages of the present invention, which to the best of our knowledge are novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE INVENTION

In a specific embodiment of the invention, a Code-Excited Linear Prediction (CELP) based compression scheme is employed. Audio compression using a CELP-based compression scheme is a common technique used to reduce data bandwidth for audio transmission and storage. Hence, any common codec for which a common codec parameter space is defined may be used. In many situations, the ability to communicate across different networks is desirable, for example from an Internet Protocol (IP) network to a cellular mobile network. These networks use different CELP compression schemes in order to communicate audio, and in particular voice. Different CELP coding standards, although incompatible with each other, generally utilize similar analysis and compression techniques.

Figure 1:
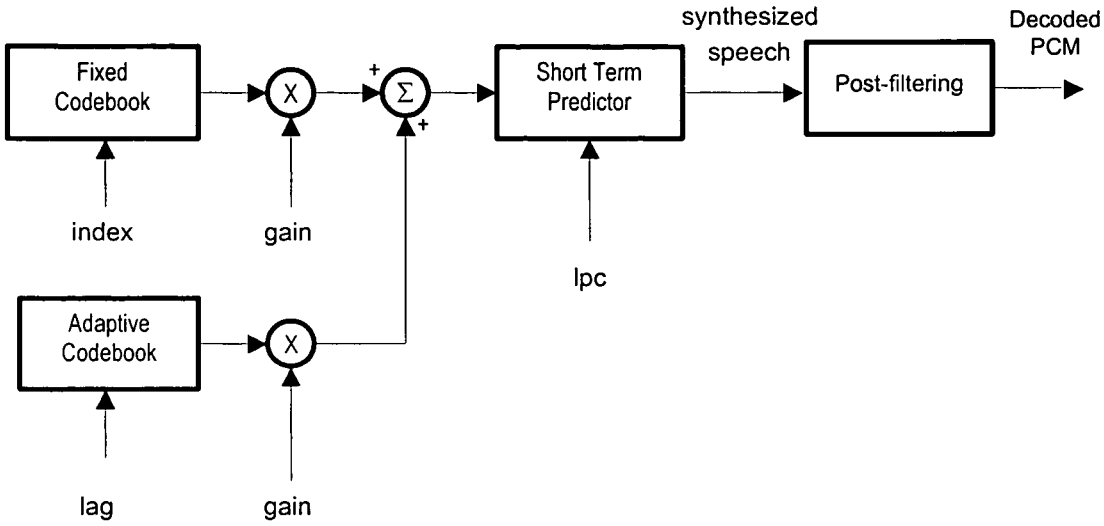
Figure 1 Prior Art
FIG. 1 is a simplified block diagram illustrating an example of a prior art CELP decoder.
Figure 2:
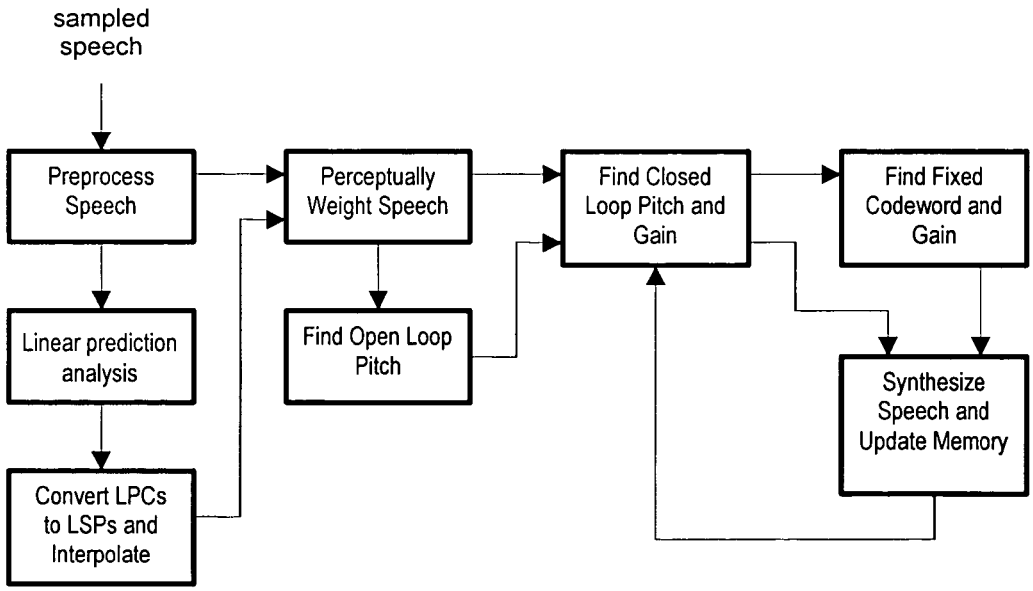
Figure 2 Prior Art
FIG. 2 is a simplified block diagram illustrating an example of a prior art CELP encoder.
Figure 3:
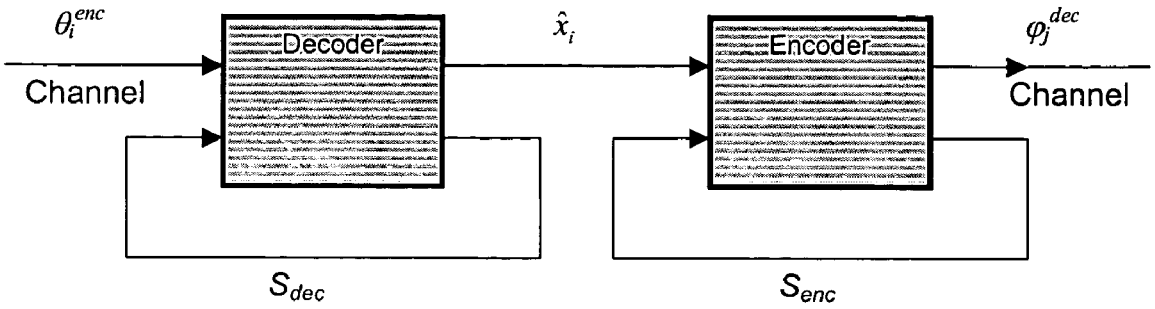
Figure 3 Prior Art
FIG. 3 is a simplified block diagram illustrating a prior art tandem coding procedure.
Figure 4:
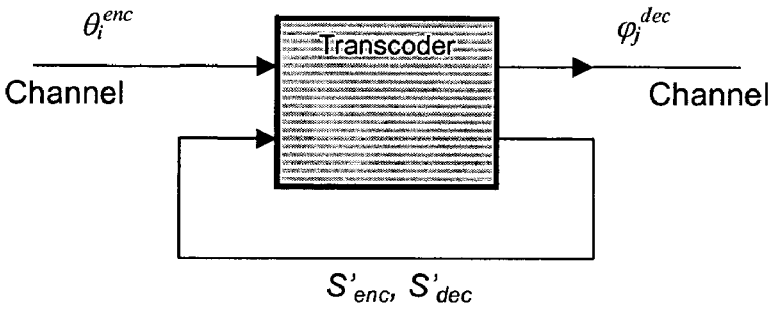
Figure 4 Prior Art
FIG. 4 is a simplified block diagram illustrating a transcoding procedure of the prior art which does not fully decode and re-encode the signal.
Figure 5:
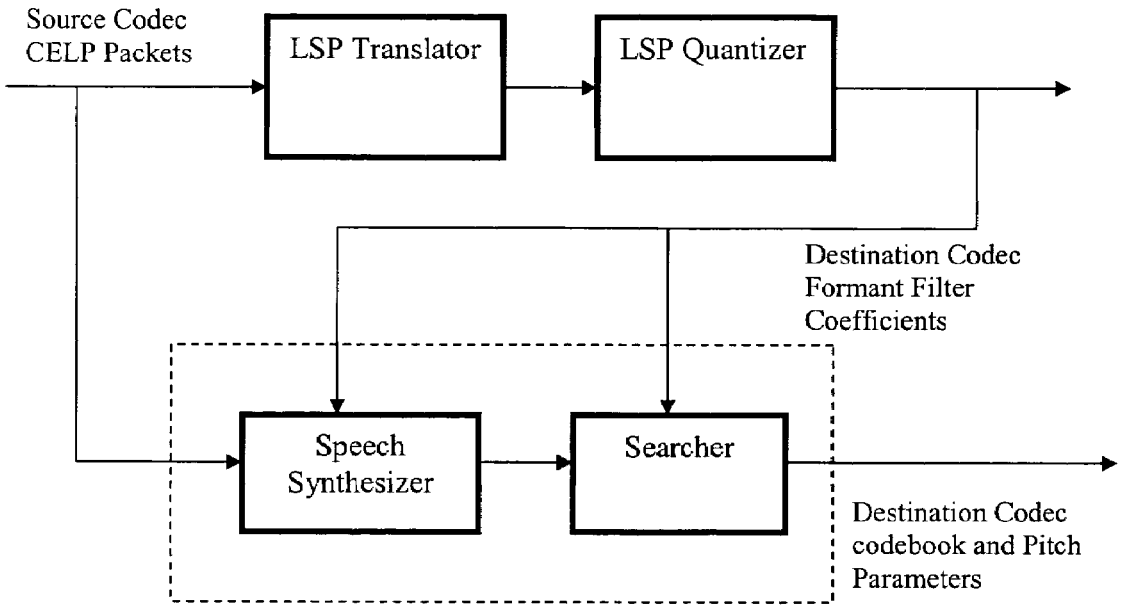
Figure 5 Prior Art
FIG. 5 is a simplified block diagram of a prior-art transcoding approach.
Figure 6:
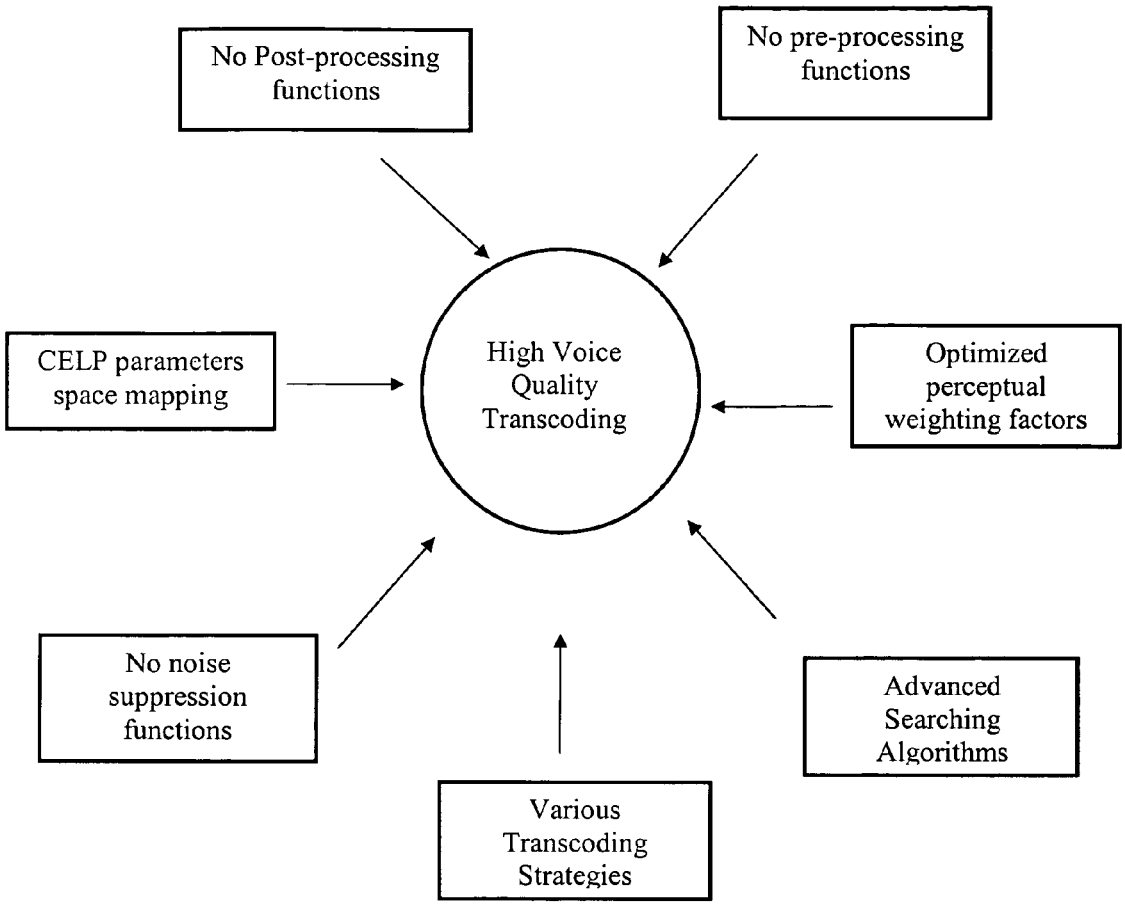
FIG. 6 is a diagram representation of high voice quality transcoder methods.

FIG. 6 shows a diagram illustrating several factors that contribute to a target or high voice quality resulting from transcoding according to the present invention. In addition to the removal of post-processing and pre-processing functions, the use of optimized perceptual weighting factors, configured transcoding strategies, mapping of parameters in the CELP domain and advanced searching functions contribute to higher quality transcoded signals.

Figure 7:
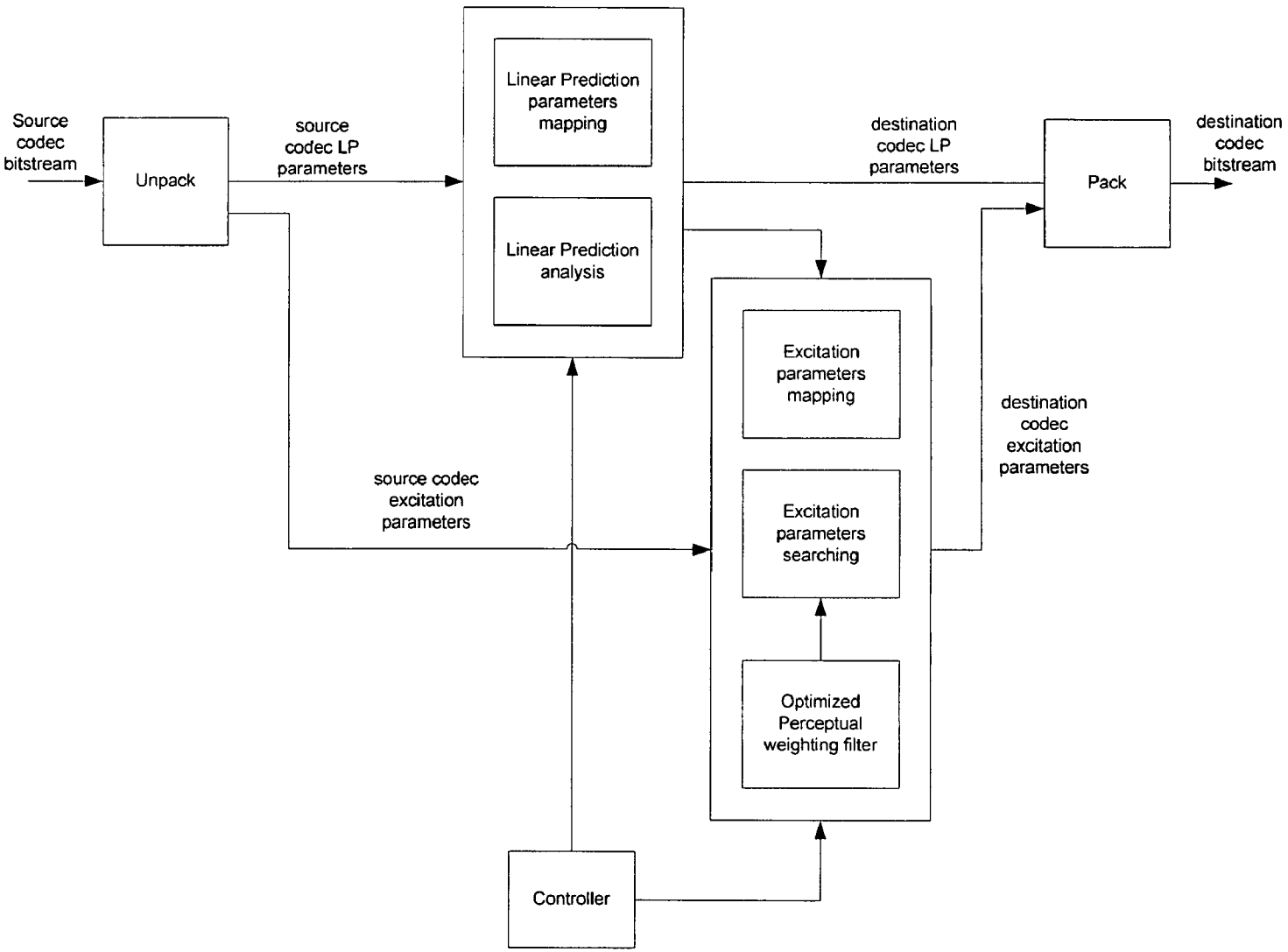
FIG. 7 is a block diagram illustrating a high voice quality transcoder from one CELP-based codec to another CELP-based codec according to an embodiment of the present invention.

FIG. 7 shows a block diagram of a high quality transcoder according to the invention. The apparatus includes a unpacking module that converts input source codec bitstream packets to a set of common codec parameters, such as CELP parameters; a linear prediction parameters generation module for determining the destination codec parameters, such as linear prediction (LP) parameters, a perceptual weighting filter module that uses tuned or customized weighting factors, an excitation parameter generation module for determining the excitation parameters for the destination codec, a packing module to pack the destination codec bitstream, and a control module that configures the transcoding strategies and controls the transcoding process. The linear prediction parameters generation module includes a linear prediction (LP) analysis module, and an LP parameter interpolation and mapping module. The excitation parameter generation module includes adaptive and fixed codebook parameter searching modules and adaptive and fixed codebook parameter interpolation and mapping modules. The control module controls whether parameter mapping or searching is performed, according to the transcoding strategy.

Figure 8:
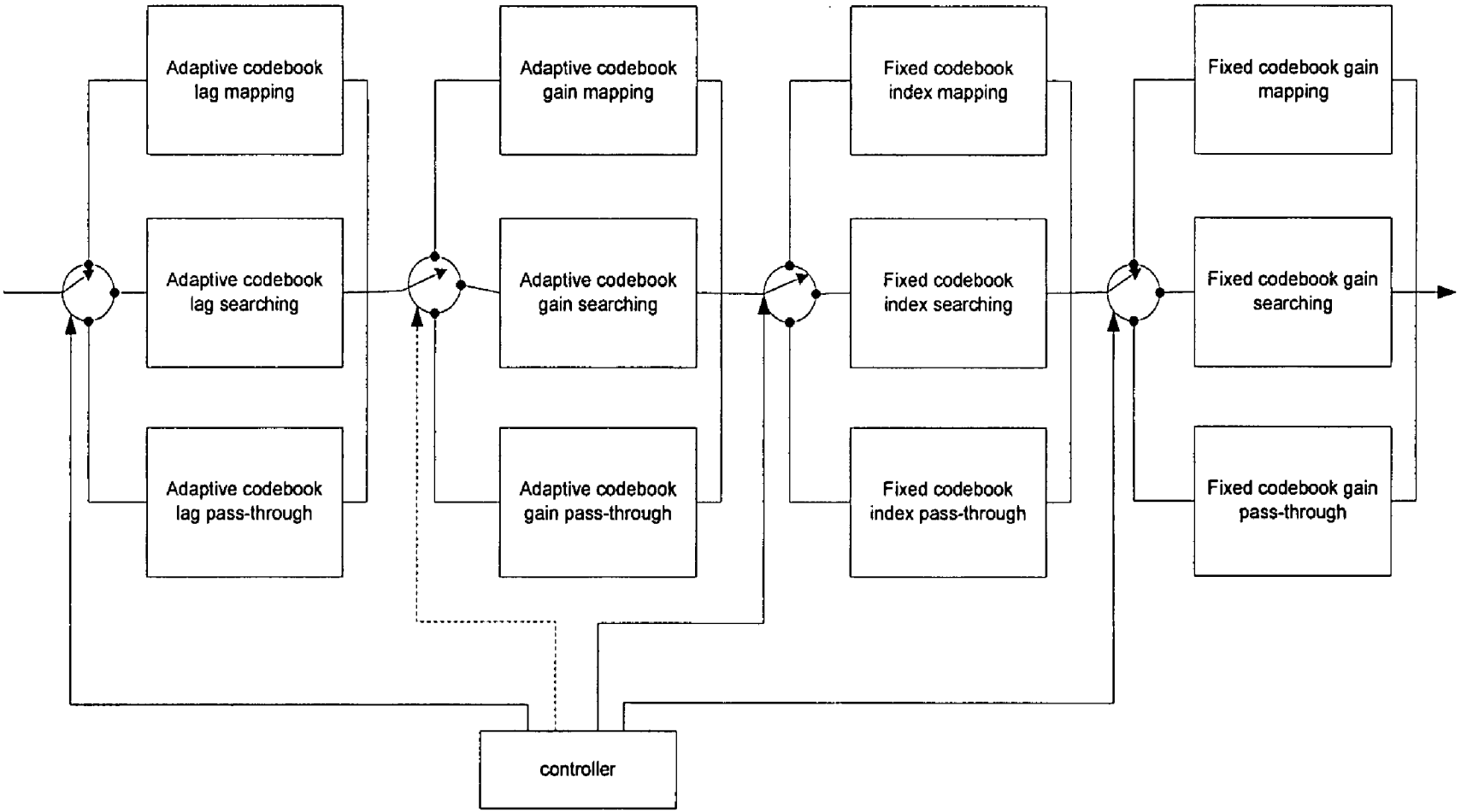
FIG. 8 is a block diagram illustrating the processing options, controlled by the transcoding strategy, in the excitation parameter generation module of a high voice quality transcoder according to an embodiment of the present invention.
Figure 9:
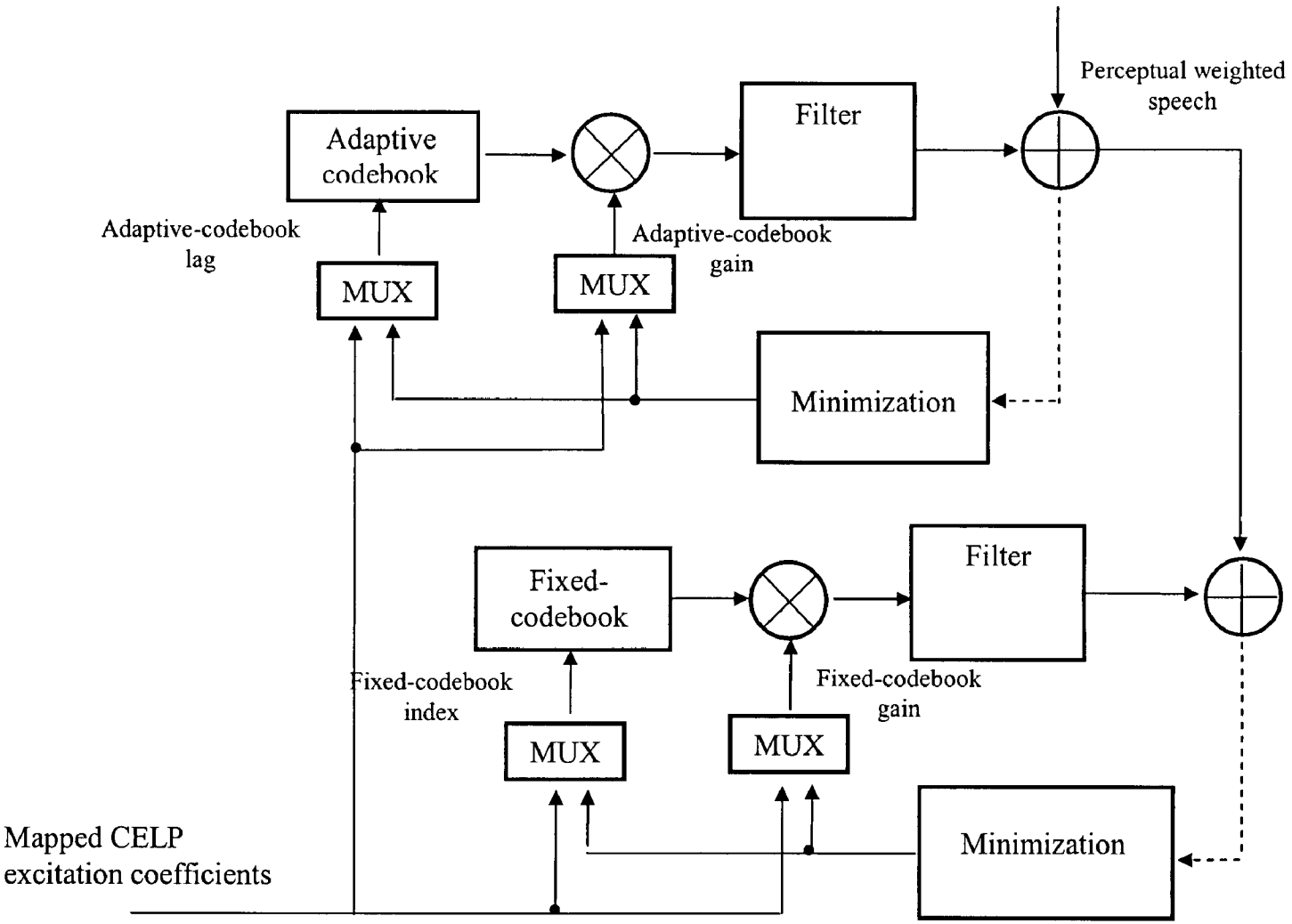
FIG. 9 is an alternative representation of an excitation parameter searching module in a high voice quality transcoder according to an embodiment of the present invention.

The transcoding strategy is configured depending on the similarities of the source and destination codecs, in order to optimize mapping from source encoded CELP parameters into destination encoded CELP parameters. FIGS. 8 and 9 illustrate the excitation parameter generation modules in which one of several searching procedures, such as direct mapping, searching, or (in the case of identical source and destination codecs) pass-through, may be chosen to determine each of the excitation parameters, depending on the transcoding strategy. The algorithms for adaptive codebook searching and fixed codebook searching in the transcoder may differ from those of the conventional or standard destination CELP codec. During searching, perceptual weighting filters are used to shape the quantization noise. The perceptual weighting factors are not necessarily the same as those defined in the destination standard. They can be further fine tuned or customized, for example, by empirical methods, taking into account the source codec characteristics. This operation can further improve audio quality.

The transcoding algorithm of the present invention can be made considerably more efficient than a conventional tandem solution by not using unneeded computationally intensive steps of source codec post-filtering, destination codec pre-filtering, destination codec LP analysis, or destination codec open loop pitch search. Further savings may be realized by directly mapping one or more excitation parameters rather than performing complex searches.

Figure 10:
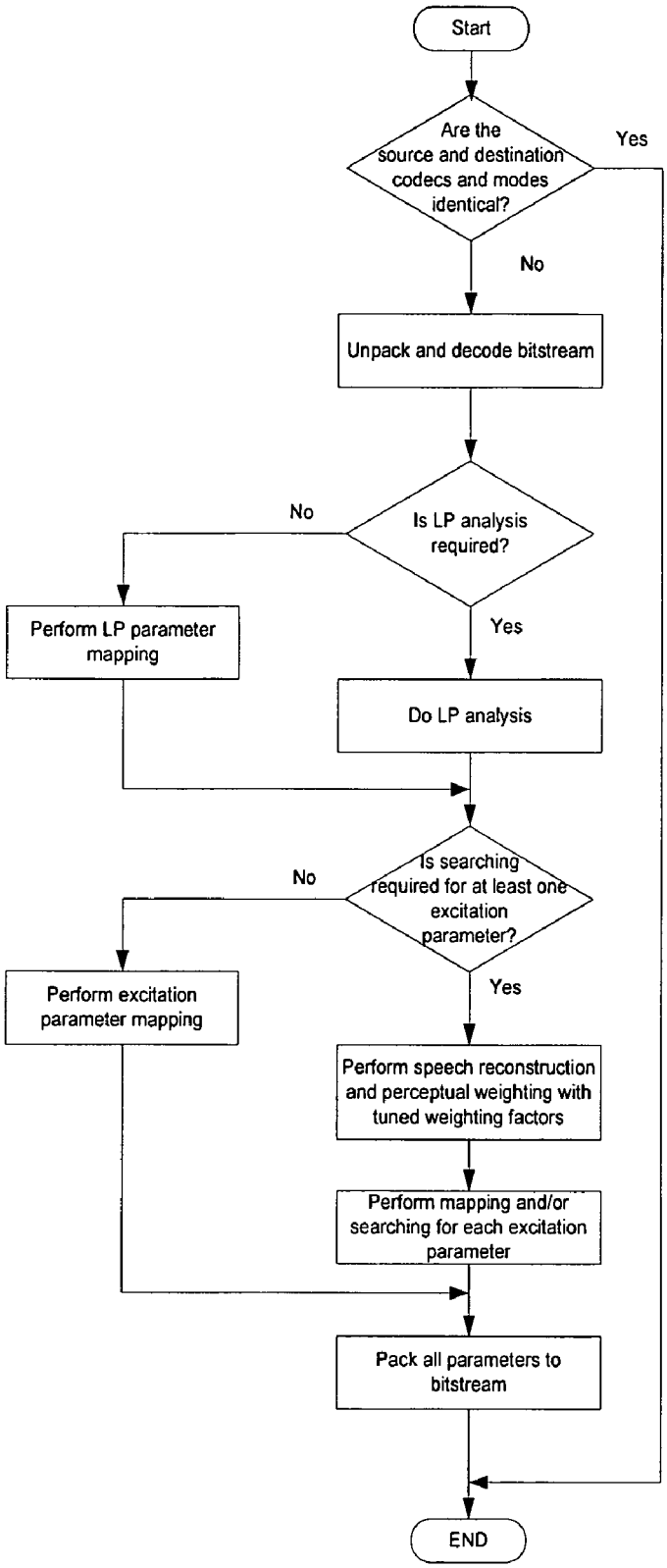
FIG. 10 is a flowchart of a high quality voice transcoding method according to an embodiment of the present invention.

A flowchart of an embodiment of the inventive voice transcoding process is illustrated in FIG. 10. If the source and destination codec type and bit-rate are the same, no (CELP) parameter searching is required, and the output bitstream is set to the input bitstream. Otherwise, the bitstream is unpacked. The excitation signal is reconstructed and the speech is synthesized. A choice is made between performing LP analysis on the synthesized speech or mapping the LP parameters from the source codec. The target and impulse response signals to determine the excitation parameters are generated using a perceptual weighting synthesis filter with weighting factors that are optimized to the specific source codec and destination codec pair. The remaining common codec (CELP) parameters are determined by searching, and then they are packed to the output bitstream.

Figure 11:
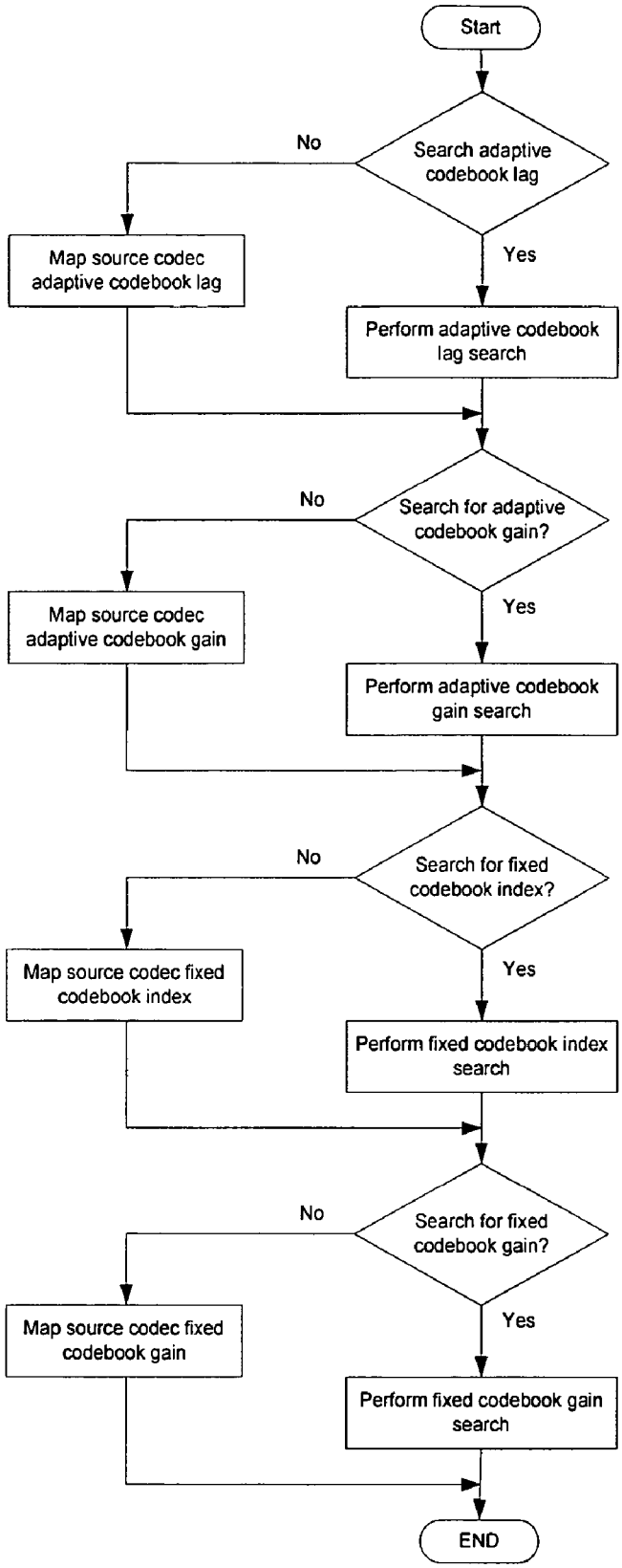
FIG. 11 is a flowchart of an excitation parameter searching method according to an embodiment of the present invention.

FIG. 11 shows a flowchart of an embodiment of the common codec (CELP) parameters searching method. For each of the common codec parameters of adaptive codebook lag, adaptive codebook gain, fixed codebook index and fixed codebook gain, a decision is made as to whether to directly map the parameter from the source codec (e.g., CELP) parameter set, or to perform a search for that parameter. The decision is controlled by the transcoding strategy selected, which is based on the source and destination codec pair.

Figure 12:
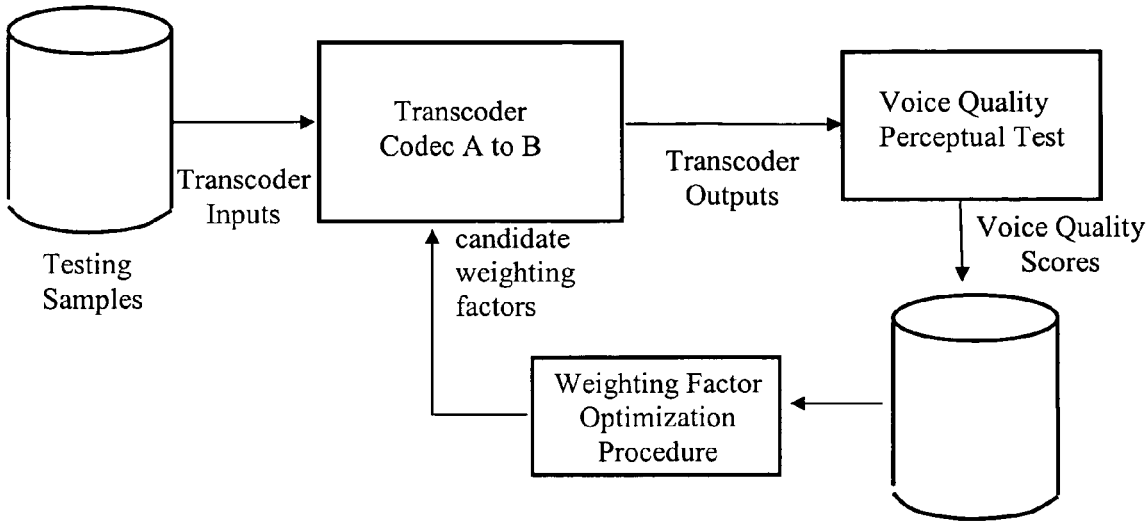
FIG. 12 is a schematic diagram of the process to obtain weighting factors for a speech perceptual weighting filter for a specific source and destination codec pair according to an embodiment of the present invention.

FIG. 12 is an illustration of the procedure used to optimize the weighting factors for the perceptual weighting filter used in searching for excitation parameters of the destination codec. The perceptual weighting filter can be expressed by the transfer function:

$$H_w(z) = \frac{A\left(\frac{z}{\gamma_1}\right)}{A\left(\frac{z}{\gamma_2}\right)},$$

where $A(z)=1+a_1z^{-1}+a_2z^{-2}+\ldots+a_Nz^{-N}$, $a_1, \ldots$ represent the linear prediction coefficients for the current speech segment, and $\gamma 1$. $\gamma 2$ are the weighting factors. The quality of the transcoded output speech can be improved by tuning or customizing the weighting factors to best suit the source and destination codec pair. This can be done using automatically using feedback methods or using empirical methods by performing the transcoding on a set of test samples using different weighting factor combinations, evaluating the output voice quality by subjective or objective methods and retaining the weighting factors that result in the highest perceived or measured output voice quality for that specific source and destination codec pair.

As an example, high quality voice transcoding is applied between GSM-AMR (all modes) and G.729. A person skilled in the relevant art will recognize that other steps, configurations and arrangements can be used without departing from the spirit and scope of the present invention.

The GSM-AMR standard utilizes a 20 ms frame, divided into four 5 ms subframes. For the highest GSM-AMR mode, LP analysis is performed twice per frame, and once per frame for all other modes. The open loop pitch estimate is obtained from the perceptually weighted speech signal. This is performed twice per frame for the 12.2 kbps mode, and once per frame for the other modes. The closed loop pitch search and fixed codeword search are both performed once per subframe, and the fixed codebook is based on an interleaved single-pulse permutation (ISPP) design.

The G.729 standard utilizes a 10 ms frame divided into two 5 ms subframes. LP analysis is performed once per frame. The open loop pitch estimate is calculated on the perceptually weighted speech signal, once per frame. Like GSM-AMR, the closed loop pitch search and fixed codeword search are both performed once per subframe, and the fixed codebook is based on an interleaved single-pulse permutation (ISPP) design.

For the G.729 to GSM-AMR transcoder, two input G.729 frames produces one GSM-AMR output frame. The LP parameters, codebook index, gains and pitch lag are unpacked and decoded from the input bitstream. Due to the differences in search procedures, codebooks, and quantization frequency of some parameters, the best transcoding strategy may differ depending on the AMR mode. In particular, the similarities associated with G.729 and AMR 7.95 kbps may lead to the configuration of a transcoding strategy that selects more parameters for direct mapping and less parameters for searching than the G.729 to AMR 4.75 kbps transcoder.

If the transcoding strategy specifies that some excitation parameters are found by searching methods, the synthesized reconstructed excitation signal is perceptually weighted to produce a target signal. The best weighting factors for the perceptual weighting filter for each mode and bit rate of the source and destination codecs of the transcoder are determined prior to transcoding. Typically, when transcoding from G.729 to AMR 12.2 kbps, a different set of weighting factors will be used than for transcoding to other AMR modes, for example, from G.729 to AMR 7.95 kbps or from G.729 to AMR 4.75 kbps.

In a transcoding scenario, the upper quality limit is the lower of the source codec quality or destination codec quality. The high quality voice transcoding of the present invention is able to significantly reduce the quality gap between the upper quality limit and the quality obtained by the tandem coding solution.

Figure 13:
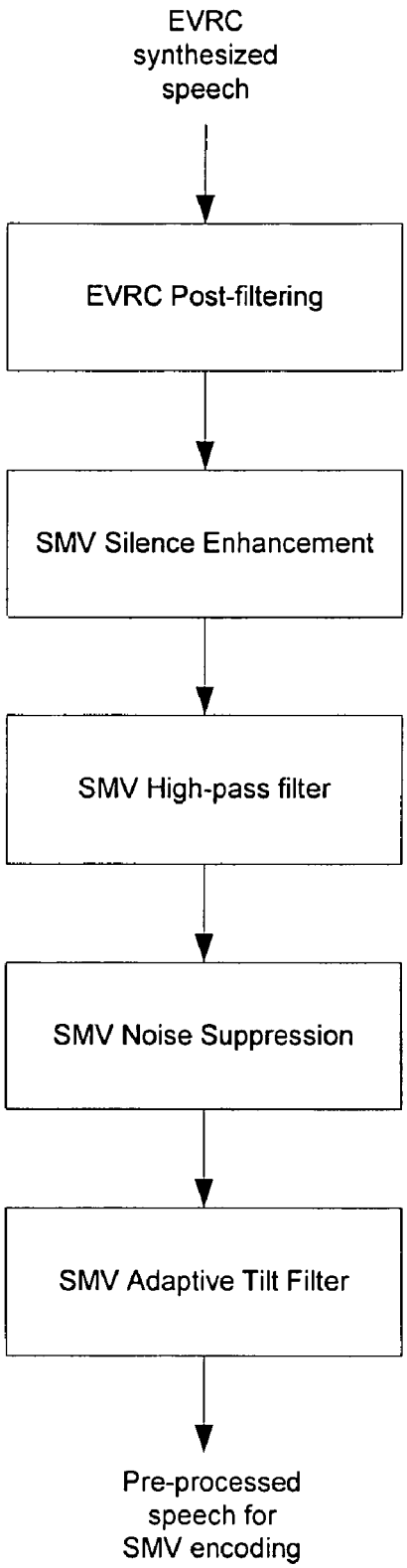
FIG. 13 is a flowchart illustrating the post-processing and pre-processing functions used in tandem transcoding from EVRC to SMV.

In an alternative embodiment, voice transcoding is applied in a transcoder whereby the source codec is the Enhanced Variable Rate Codec (EVRC) and the destination codec is the Selectable Mode Vocoder (SMV). SMV and EVRC are both common codec parameters types that employ built-in noise suppression algorithms. A flowchart of the post-processing functions of EVRC and the pre-processing functions of SMV used in the tandem transcoding solution is illustrated in FIG. 13. A transcoding solution with lower complexity and higher quality than the tandem transcoding solution can be achieved by removing one or more of the processes of EVRC postfiltering, SMV highpass filtering, SMV silence enhancement, SMV noise suppression, and SMV adaptive tilt filtering. Since EVRC already uses noise suppression, much of the background noise in the input has already been removed at the source encoder, hence a second noise suppression algorithm during transcoding causes further speech degradation with little change to the background noise level. Further complexity reductions and/or quality improvements can be realized using the optimization of perceptual weighting factors, and the mixed transcoding strategy of mapping some parameters in the CELP domain and determining some by searching.

The present invention for high voice quality transcoding is generic to all voice transcoding between CELP-based codecs and applies any voice transcoders among the existing codecs G.723.1, GSM-EFR, GSM-AMR, EVRC, G.728, G.729, SMV, QCELP, MPEG-4 CELP, AMR-WB, and all other future CELP based voice codecs that make use of voice transcoding. The foregoing common codec standards for each of which a common codec parameter space is defined are considered exemplary but not limiting.

The foregoing description of specific embodiments is provided to enable a person having ordinary skill in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What is claimed is:

1. An apparatus for a voice transcoder that produces a destination code bitstream in a destination codec format from a source code bitstream in a source codec format, the apparatus comprising:

an unpacking module operative to unpack the source codec bitstream and decode the information into at least one parameter of a common codec for which a common codec parameter space is defined;

a linear prediction parameters generation module operative to generate destination codec linear prediction parameters by mapping from source codec linear prediction parameters or by linear prediction analysis;

a perceptual weighting filter module operative to use weighting factors that have been optimized for transcoding between a specific source codec and destination codec pair;

an excitation parameter generation module for determining at least one common codec excitation parameter in the destination codec format, said parameter generation module operative to provide direct mapping processes and searching processes for each said common codec excitation parameter;

a packing module operative to pack the destination codec common codec parameters to the bitstream; and a control module for selecting a transcoding strategy and to provide additional control information.

2. The apparatus of claim 1, wherein said linear prediction parameters generation module comprises:

a linear prediction parameters mapping and conversion module for interpolating the linear prediction parameters upon determination of a difference between source codec frame size and destination codec frame size, and for mapping the linear prediction parameters to the destination codec format; and a linear prediction analysis module for generating linear prediction parameters from a reconstructed speech signal.

3. The apparatus of claim 1, wherein optimized weighting factors of said perceptual weighting filter module are pre-computed prior to transcoding and storing as part of the apparatus.

4. The apparatus of claim 1, wherein said excitation parameter generation module comprises:

first modules for direct mapping of the source codec excitation parameters format to the destination codec excitation parameters format;

second modules for searching for said source codec excitation parameters and said destination codec excitation parameters; and pass-through modules for third excitation parameters, said third excitation parameters being used if the types of said source codec and said destination codec and respective bit-rates are the same.

5. The apparatus of claim 4, wherein said first modules for direct mapping of excitation parameters comprise an adaptive codebook pitch lag mapping module, an adaptive codebook pitch gain mapping module, a fixed codebook gain mapping module, and a fixed codebook index mapping module.

6. The apparatus of claim 4, wherein said second modules for searching for excitation parameters comprise an adaptive codebook pitch lag searching module, an adaptive codebook pitch gain searching module, a fixed codebook gain searching module, a fixed codebook index searching module, and an excitation reconstruction module.

7. The apparatus of claim 4, wherein said pass-through modules for excitation parameters comprise an adaptive codebook pitch lag searching module, an adaptive codebook pitch gain searching module, a fixed codebook gain searching module, a fixed codebook index searching module and an excitation reconstruction module.

8. The apparatus of claim 1, wherein said control module is operative to employ a transcoding strategy comprising a set of rules to determine a specific process of transcoding.

9. The apparatus of claim 1, wherein said linear prediction parameters generation module is controlled by said control module.

10. The apparatus of claim 1, wherein said excitation parameter generation module is controlled by said control module.

11. The apparatus of claim 1, wherein reconstructed speech of the source codec is not pre-processed.

12. The apparatus of claim 1 having no noise suppression functions.

13. The apparatus of claim 1 having no post-filtering and no gain adjustment.

14. A method for producing a destination code bitstream in a destination codec format from a source code bitstream in a source codec format in order to perform voice transcoding between common codec parameter-based voice codecs comprising:

determining and storing weighting factors for a perceptual weighting filter, said weighting factors being optimized for a specific source codec and destination codec pair;

configuring transcoding strategies for each preselected transcoding pair;

unpacking said source codec bitstream to produce source codec common codec parameters;

reconstructing a speech signal using source codec common codec parameters;

mapping one or more parameters in parameter space of the common codec parameters according to a selected transcoding strategy;

perceptually weighting voice signals using said perceptual weighting filter according to the selected transcoding strategy;

searching for one or more excitation parameters according to the selected transcoding strategy; and packing the destination codec common codec parameters to the destination codec bitstream.

15. The method of claim 14, wherein said common codec parameters are defined by a linear code, further including the interim step of:

performing linear prediction analysis according to the selected transcoding strategy to determine linear prediction coefficients for further processing.

16. The method of claim 14, wherein said excitation parameters mapping comprises determining quantized values of at least one of adaptive codebook pitch lag, adaptive codebook pitch gain, fixed-codebook index and fixed-codebook gain by interpolating the source codec parameters upon determination of at least one of a difference in frame size, subframe size, and mappable characteristics between the source codec and the destination codec; and directly converting the excitation parameters to the destination codec format.

17. The method of claim 14, wherein said excitation parameters searching step comprises determining quantized values of at least one of adaptive codebook pitch lag, adaptive codebook pitch gain, fixed-codebook index, and fixed-codebook gain by minimizing the error between a reconstructed signal and a target signal.

18. The method of claim 14, wherein transcoding strategies configuring step comprise selecting a number of respective mapping and searching options to determine signal processing flow.

19. The method of claim 14 wherein the transcoding strategy specifies a process whereby some parameters are first obtained from said common codec parameter mapping and remaining parameters are obtained through a searching procedure.

20. The method of claim 14, wherein the transcoding strategy specifies a process whereby all common codec parameters from the source codec are mapped to the destination codec without searching.

21. The method of claim 14, wherein reconstructing a speech signal involves no post-processing operations.

22. The method of claim 14, wherein no noise suppression or speech pre-processing is performed prior to speech perceptual weighting.

23. The method of claim 14, wherein said transcoding strategies comprise:

direct mapping of a code-excited linear prediction parameter upon determination of presence of a similar code-excited linear prediction parameter compression process between the source codec and destination codec of the transcoding pair;

performing speech reconstruction and speech perceptual weighting if searching is required to determine code-excited linear prediction parameters for the destination codec;

performing linear prediction analysis if there are substantial differences in linear prediction parameter compression processes between the source codec and the destination codec in a transcoding pair, and if the steps of linear prediction parameter interpolation, mapping, and conversion do not produce a target output voice quality in the transcoding;

searching the adaptive codebook, if LP analysis processing is required;

searching the adaptive codebook, 1) if the adaptive codebook parameter compression process has substantial differences between source codec and destination codec in a transcoding pair, and 2) the adaptive codebook parameter space mapping method does not produce the target output voice quality in the transcoding;

searching the fixed codebook, if adaptive codebook searching is required;

searching the fixed codebook, if the fixed codebook parameter compression process has substantial differences between source codec and destination codec in a transcoding pair, and if the fixed codebook parameter space mapping method does not produce the target output voice quality in the transcoding.

24. The method of claim 14, wherein said weighting factors obtaining step comprises transcoding a set of voice samples using different weighting factor values, performing voice quality tests on the transcoded voice signals, and selecting specific weighting factors for a specific source codec and destination codec pair in order to produce a target voice quality.

25. The method of claim 14, wherein said weighting factors obtaining step comprises finding best weighting factors for each possible mode and bit rate combination of the source codec and the destination codec.

* * * * *